United States Patent [19]

Pundsack

[11] 4,021,110

[45] May 3, 1977

[54] PHOTOCOPYING CAMERA AND PROCESSING DEVICE

[75] Inventor: Arnold L. Pundsack, Oakville, Canada

[73] Assignee: Xerox Corporation, Stamford, Conn.

[22] Filed: Apr. 30, 1975

[21] Appl. No.: 573,294

[52] U.S. Cl. ..... 355/10; 219/216; 354/317; 355/27; 355/100

[51] Int. Cl.[2] ..... G03G 15/10

[58] Field of Search ..... 355/3 R, 10, 16, 100, 355/106, 27; 354/299, 317; 219/216

[56] References Cited

UNITED STATES PATENTS

| | | | |
|---|---|---|---|
| 3,060,829 | 10/1962 | Leighton et al. | 354/317 X |
| 3,177,790 | 4/1965 | Turner et al. | 354/317 X |
| 3,506,348 | 4/1970 | Brodie | 355/16 |
| 3,597,063 | 8/1971 | Hayashi et al. | 355/16 X |
| 3,741,651 | 6/1973 | Nishiyama et al. | 219/216 X |
| 3,768,906 | 10/1973 | Michelson et al. | 355/100 X |
| 3,816,114 | 6/1974 | Fukushima et al. | 355/10 X |
| 3,849,171 | 11/1974 | Takahashi et al. | 355/10 X |
| 3,901,188 | 8/1975 | Eberlein | 355/10 X |
| 3,902,041 | 8/1975 | May | 219/216 |

*Primary Examiner*—Fred L. Braun

[57] ABSTRACT

A camera/processor for, in a preferred mode, continuously exposing and developing photographic film, and preferably, photographic migration imaging film. The versatility of the apparatus is demonstrated by its ability to perform either heat or meniscus development and, optionally, film overcoating. After the film is exposed, it travels along a predetermined path, which path may include a plurality of separate film developing and film drying stations, toward a takeup reel.

5 Claims, 11 Drawing Figures

PHOTOCOPYING CAMERA AND PROCESSING DEVICE

BACKGROUND OF THE INVENTION

This invention is directed in general to automatic camera processors and in particular to automatic camera/processors capable of providing rapid access to processed film which provides a record of the original exposure.

The novel camera/processor of the instant invention takes advantage of new and simplified imaging systems which are capable of micro-image format of high density, continuous tone and high resolution. As will be explained further, preferred embodiments of the invention employ the process variations of these new systems to provide apparatus which can operate at from very low rates to camera framing rates suitable for motion picture reproduction.

The storage of information on micro-film evolved as one special application of conventional photographic technology. As a result, process orientation was based on the processing of photographic film, not on the processing of information. Adhering to the relatively complex darkroom technique used for conventional film, usual rapid processing equipment is engineered for the economics of high volume bulk processing of motion picture film. In rapid processing display systems such as those shown in the Tuttle U.S. Pat. No. 2,922,325 issued Jan. 26, 1960; or the Orlando U.S. Pat. No. 2,856,829, issued on Oct. 21, 1958 apparatus is shown for rapid camera processing systems using a chamber method of development. In these and other simple camera/processors, multiple low viscosity processing fluids are drawn from suitable containers across the emulsion side of silver halide film either by positive pressure or a suction pump. Another developmental recorder/processor system was described in an S.P.S.C. Conference in Chicago in May of 1967 (T. E. Gagnon "Rapid Reversal Process for CRT Images", S.P.S.C. Conference, Chicago; May 1967, page 85). Negative images are created therein by a process similar to those described immediately above.

An example of the new imaging system of the type considered to be useful in the camera/processor of the instant invention is that which is described in U.S. Pat. No. 3,520,681. Generally, according to an embodiment thereof, an imaging member comprising a conductive substrate with a layer of softenable (herein also intended to include soluble) material, containing photosensitive particles overlying the conductive substrate is imaged in the following manner; a latent image is formed on the member, for example, by uniformly electrostatically charging and exposing it to a pattern of activating electromagnetic radiation. The imaging member is then developed by exposing it to a solvent which dissolves only the softenable layer. The photosensitive particles which have been exposed to radiation migrate through the softenable layer as it is softened and dissolved, leaving an image of migrated particles corresponding to the radiation pattern of the original on the conductive substrate. The image may then be fixed to the substrate. Through the use of various techniques, either positive-to-positive or positive-to-negative images may be made. Those portions of the photosensitive material which do not migrate to the conductive substrate may be washed away by the solvent with the softenable layer.

The process embodiment described in the immediately preceeding paragraph encompasses only one of the known species for development of migration images by reducing the resistance of the softenable layer to migration of migration material. The primary consideration in the development of migration images is that the resistance of the softenable layer be reduced sufficiently to allow migration—exactly how this is done is generally unimportant. The camera/processor to be described herein employs generally three of the known species of development, solvent wash-away, heat softening, and to some extent solvent softening. Examples of all three abound in the migration imaging art, and for further explanation and understanding of the processes and relative advantages, attention is directed to issued patents therein.

In general, three basic imaging members may be used. A layer configuration which comprises a conductive substrate coated with a layer of softenable material, and a fracturable and preferably particulate layer of photosensitive material on or embedded near the upper surface of the softenable layer; a binder structure in which the photosensitive particles are dispersed in the softenable layer which overcoats a conductive substrate; and an overcoated structure in which a conductive substrate is overcoated with a layer of softenable material followed by an overcoating of photosensitive particles and a second overcoating of softenable material which sandwiches the photosensitive particles.

The characteristics of the images produced in this new system are dependent on such process steps as charging, exposing and developing, as well as the particular combination of process steps. High density, continuous tone, and high resolution are some of the image characteristics possible. The image is generally characterized as a fixed or unfixed particulate image with or without a portion of the softenable layer in unmigrated portions of the layer left on the imaged member, which can be used in a number of applications such as microfilm, hard copy, optical masks, and strip-applications using adhesive materials.

At this point, it should also be recognized that imaging films and processes other than those known in migration imaging may be employed in the apparatus to be described hereinbelow. For example, KALVAR from Kalvar Corp. of New Orleans, LA., and other vesicular, heat developable, films may be developed on the heated roller. Also, Scott Graphic Films and other liquid ink developable films may be developed by the meniscus station.

Two camera/processors for migration imaging film are described in U.S. Pat. Nos. 3,528,355 and 3,542,465.

SUMMARY OF THE INVENTION

It is an object of this invention to provide a unique high-speed camera/processor utilizing photographic film, and preferably photographic migration imaging film.

It is another object of this invention to provide a unique, compact high-speed camera/processor for migration imaging films which is reliable, simple and convenient to use.

It is a further object of this invention to provide a versatile camera/processor which utilizes the unique characteristics of migration imaging film to provide either heat developed or meniscus developed images.

It is a further object of this invention to provide a camera/processor which is capable of heat or meniscus development of migration imaging film and overcoating the developed film with a protective material.

It is another object of this invention to provide a unique camera/processor with the versatility of employing many different imaging processes including migration, vesicular, heat and liquid development.

It is another object of this invention to provide a camera/processor which is capable of imaging and processing at both single and continuous framing rates.

The above and other objects are accomplished by providing a camera/processor for, in a preferred mode, continuously exposing and developing photographic film, and preferably photographic migration imaging film. The versatility of the apparatus is demonstrated by its ability to perform either heat or meniscus development and, optionally, film overcoating.

BRIEF DESCRIPTION OF THE DRAWINGS

The advantages of this invention will become apparent on consideration of the following detailed disclosure of the invention, especially when it is taken in conjunction with the accompanying drawings wherein.

DESCRIPTION OF THE PREFERRED EMBODIMENTS

Figure 1:
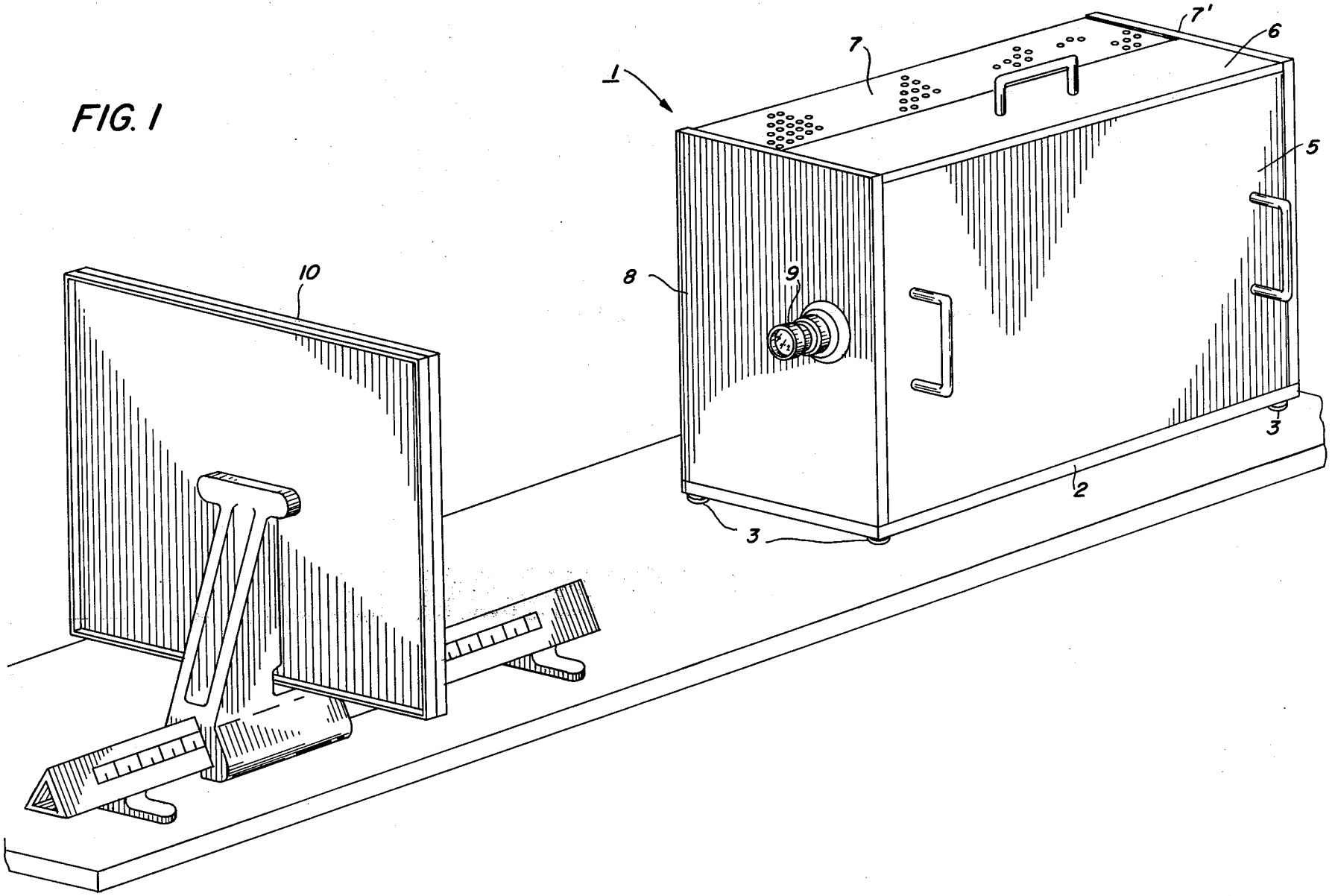
FIG. 1 is a perspective view of the camera/processor of the instant invention.

Referring now to FIG. 1, a perspective view of the camera/processor 1 can be seen in its entirety set up for operation. The internal elements can be seen in other figures, but the enclosure itself comprises a sturdy cabinet with removable wall elements. A base plate 2 is supported on adjustable corner legs 3 which permit ease of leveling and lens alignment. Within the cabinet itself, there is a midrib 4 which extends the entire length thereof and divides the cabinet into two compartments. The midrib cannot be seen in FIG. 1, but may be identified easily in FIGS. 2 and 3 as the primary support for the apparatus elements. Side panel 5 is removable, as are top panel 6, side panel 7 and rear panel 7'. The compartment behind side panel 5 should be light tight to prevent unwanted exposure of the sensitized film during operation. Side panel 7 need not be light tight and is, in fact, preferably perforated to allow free circulation of air.

The front panel 8 may be fixed to the base plate 2 and midrib 4 and is adapted to support, inter alia, the camera lens 9. For purposes of illustration, a target 10 is shown adjacent lens 9.

Figure 2:
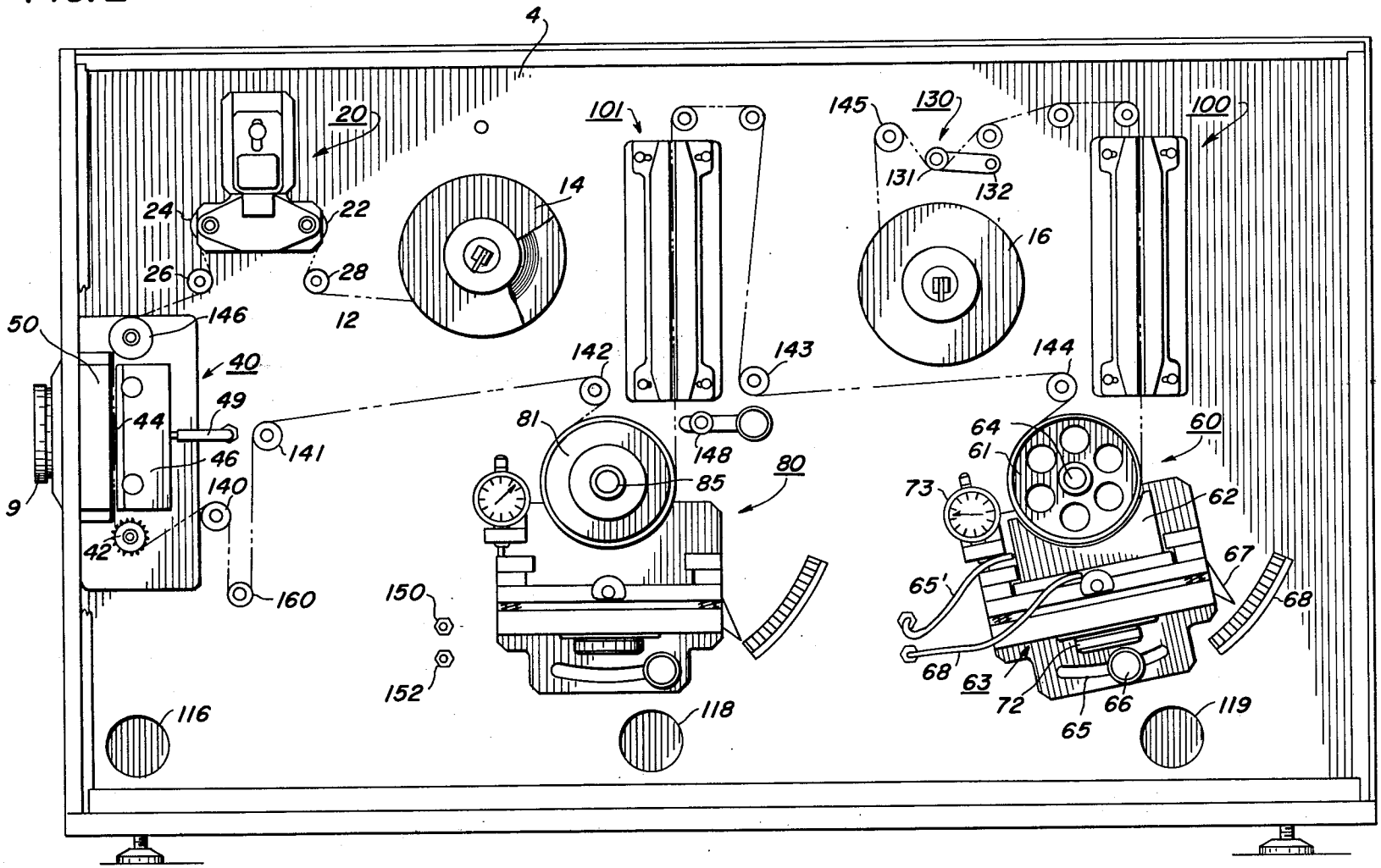
FIG. 2 is a partially schematic side plane view of the camera/processor showing a preferred embodiment of the film path and elements of the apparatus.

The preferred embodiment of the camera/processor shown in FIG. 2 is designed to record the image from an original input on 16mm, 35mm or 70mm single perforated, double perforated or non-perforated film, and also to process the images thereon. The multi-format film handling unit is capable of operating with a variety of film sizes, film speeds and shutter speeds as tabulated below.

| Size of Film | Film Speed | Shutter Speed |
|---|---|---|
| 16 mm | 0.4 to 4.5 in/sec Continuously Variable | 0 to 15 frames/sec |
| 35 mm | 0.2 to 1.8 in/sec Continuously Variable | 0 to 6 frames/sec |
| 70 mm | 0.1 to 1.0 in/sec Continuously Variable | 0 to 3 frames/sec |

Also, it should be noted that, as will be seen further below, the film may be exposed and processed in either single frame, or continuously variable modes.

As the film 12 moves from the supply reel 14 to the takeup reel 16, it passes through the different process stations, i.e., charging 20, exposure 40, development 80 and overcoating 60. Modifications to the preferred embodiment will be described in further detail below.

The nature of the migration imaging process and imaging members makes it desirable and advantageous that the film be grounded at specific locations in the film transport system. More specifically, the apparatus shown in FIG. 2 is grounded by conductive sprockets or rollers at the charging zone 20 and the transport-drive zone of exposure station 40 (rollers 22, 24, 30 and 42). Additionally, the film reel spools 14 and 16 are conductive and grounded.

Charging Station

Figure 4:
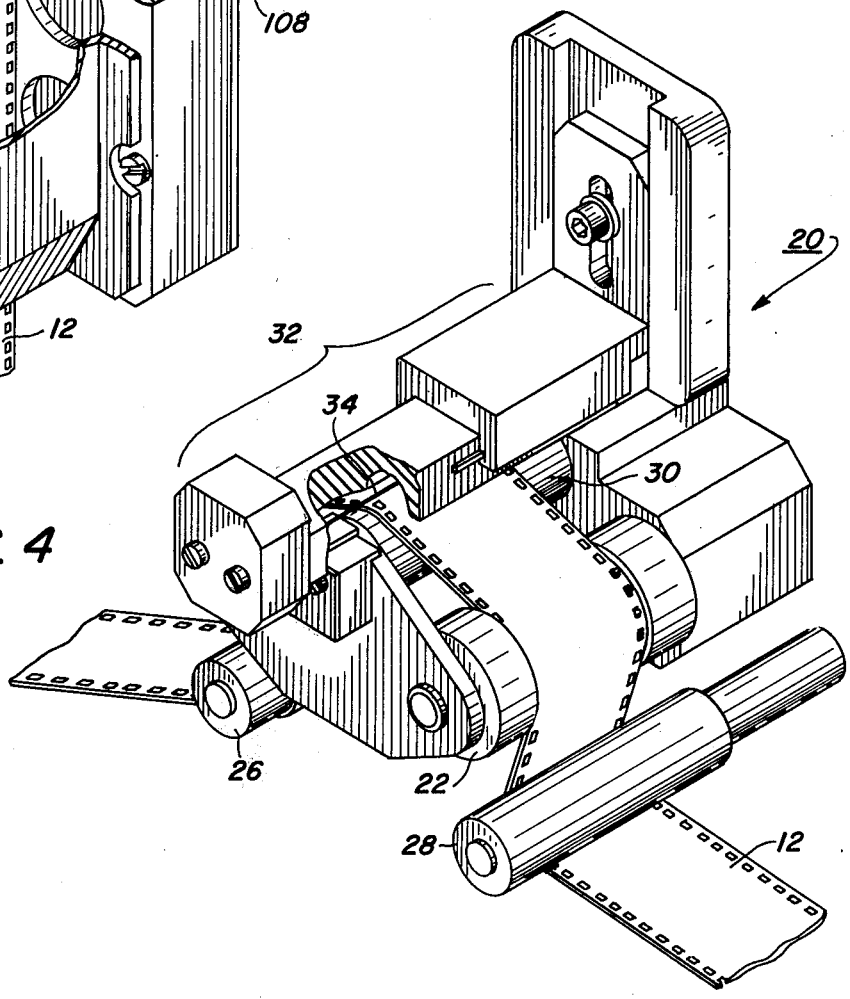
FIG. 4 is a partially schematic, perspective view of the charging apparatus 20 of FIG. 2.

In charging station 20 film sensitization is accomplished by providing a uniform electrostatic charge thereon. Attention is directed to FIG. 4 for the detailed description. The film 12 shown as 35mm double perforated, enters and exits the station in good contact with electrically grounded rollers 22 and 24 (roller 24 cannot be seen in FIG. 4) due to the positioning of guide rollers 26 and 28. Positioned between rollers 22 and 24 is an additional guide roller 30 which is also electrically grounded and raised out of the plane of the rollers 22 and 24 to present a flat surface of film to be charged.

Corona discharge device 32 is adjustably mounted near the above-mentioned rollers whereby coronode wire 34 is positioned adjacent the film surface, parallel to the axis of roller 30. Coronoda 34 may be biased either positive or negative to deposit charge on the film as it is moved through the system.

Typical corona discharge systems are described by Carlson in U.S. Pat. No. 2,588,699. Alternatively, the film could be contact charged as described by Carlson in U.S. Pat. No. 2,797,691, by means of a roller held at a high potential as taught by Gregay et al, in U.S. Pat. No. 2,980,834 or by means of a conductive liquid at a high potential as described by Walkup in U.S. Pat. No. 2,987,600. Any suitable charging means may be used.

It should be noted here that critical guide rollers throughout the system, including rollers 22 and 24, are capable of securely receiving 16mm, 35mm and 70mm film. See roller 88 in FIG. 6 wherein lands 90, 91 and 92 for receiving the various width films can be seen.

As stated, the versatile guide roller described immediately above is used throughout the system at strategic locations. More specifically, rollers 140–146 are all of this design. The remaining rollers may be of any conventional flat design such as shown in FIG. 8*b*.

Exposure Station

The exposure station 40 may take any form well known in the art. This station does not form a specific part of the invention, but will be discussed for purposes of illustration.

Figure 3:
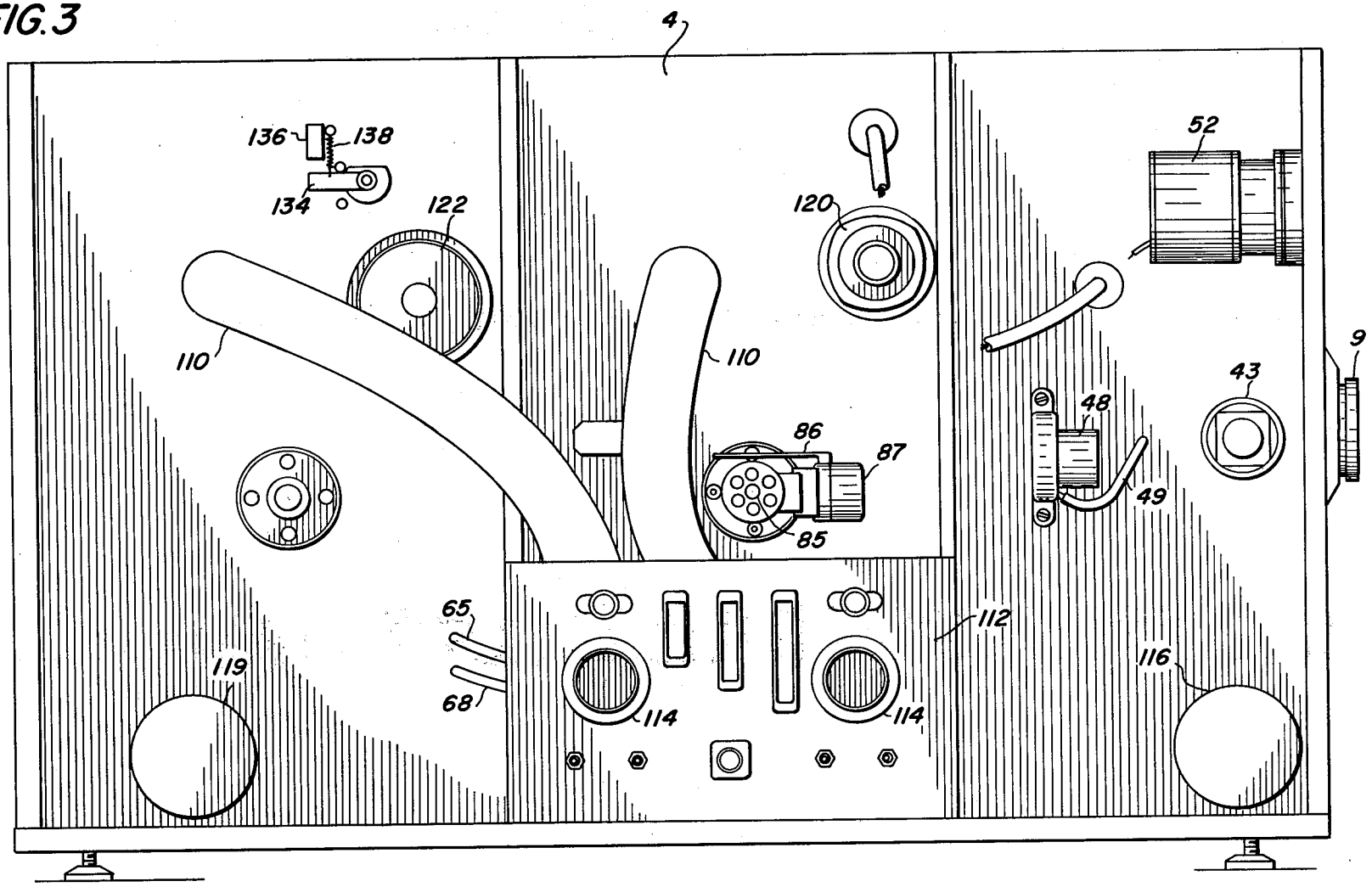
FIG. 3 is a partially schematic side plane view of the camera/processor showing the side opposite of that of FIG. 2.

Referring now to FIGS. 2 and 3, it can be seen that the film 12 passes through the exposure station from roller 146 to drive roller 42, which is driven by DC motor 43. Drive roller 42 is interchangeable for the various size films, or, alternatively may comprise a multi-faceted roller, similar to roller 146, for example, with sprocket teeth for the 16mm, 35mm and 70mm films. For the non-perforated films, it is necessary to position a roller adjacent the drive roller and bias it into contact therewith to promote friction. The film 12 is held in a flat position within slot 44 by a conventional vacuum plate 46. Suitable vacuum platens are known in the art such as, for example, those shown in U.S. Pat. Nos. 3,528,355 and 3,645,621. Platen 46 is connected to a source of vacuum pump 48, (FIG. 3) via tube 49.

The shutter mechanism, within housing 50, is driven by D.C. stepper motor 52 (FIG. 3). The shutter itself may comprise any suitable device known in the art, for example, a perforated rotatable disc which is in sync with the film drive. The disc may be exchanged for one with larger diameter apertures when switching from 16mm to 70mm film, for example. In the alternative, a single shutter may be employed with a variable iris size, selectable for 35mm, 16mm or 70mm films.

Overcoating Station

Overcoating station 60 will be described prior to heat development station 80 because of the interchangeability and commonality of elements.

Figure 5:
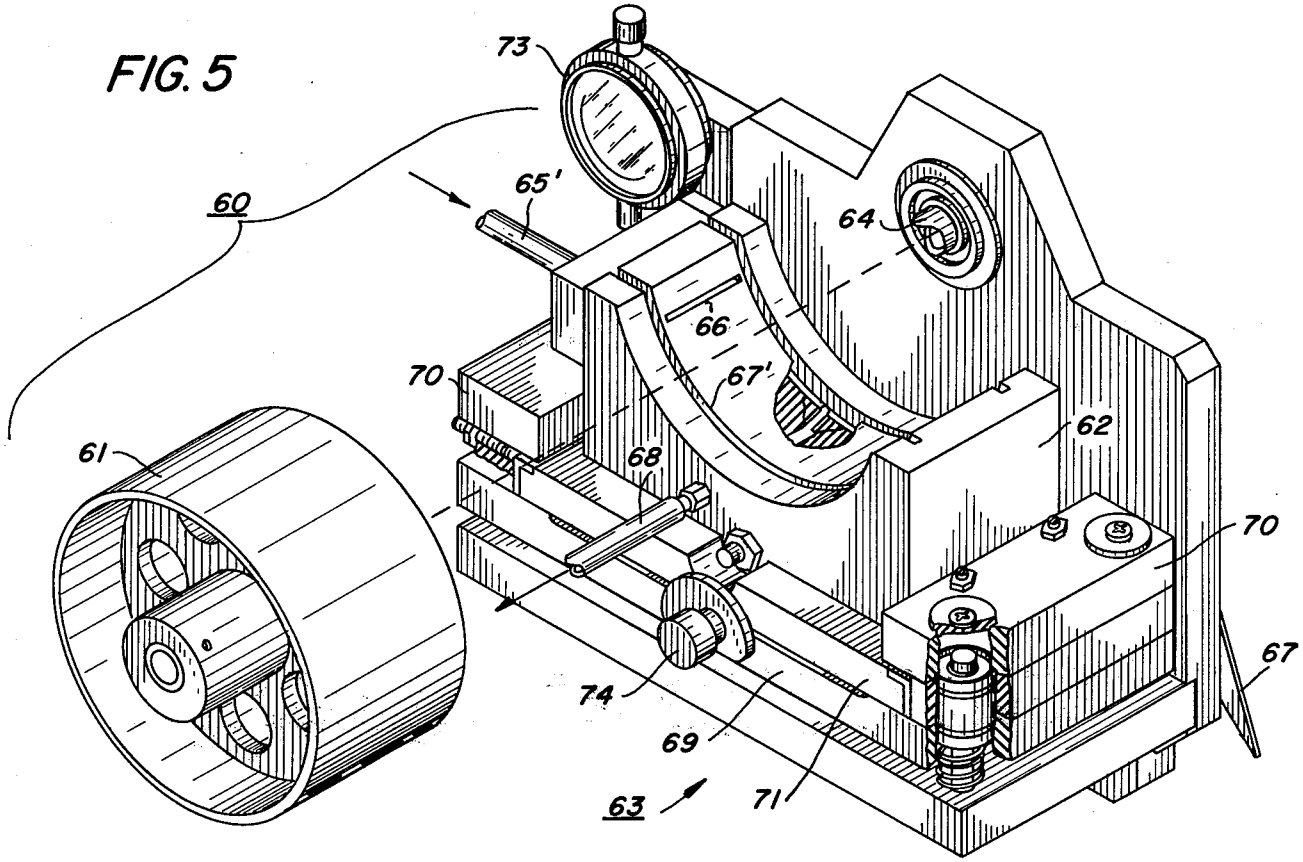
FIG. 5 is a partially schematic, perspective view of the meniscus development or overcoating station 60 of FIG. 2.

Referring now to FIGS. 2, 3 and 5, overcoating station 60 can be seen to comprise three basic elements, drum 61, shoe 62 and base 63. The critical relationships which this apparatus controls include the gap size between the drum 61 and shoe 62, and the angle of the shoe relative to a vertical plane through the axis of the drum. Base 63 comprises an L-shaped bracket which is mounted for at least partial rotation about shaft 64, which also allows for the free rotation of drum 61. The base 63 further includes a curved slot 65 at the bottom thereof (FIG. 2) through which lock nut 66 extends. Lock nut 66 is threaded into midrib 4 and, when tightened, fixes the angle of the shoe relative to the vertical. Pointer 67 is fixed to base 63 and indicates the angle on scale 68.

The base 63 further includes an adjustable plate 69 and brackets 70 which hold the shoe 62 and shoe base 71 in adjustable relationship to the drum 61. Threaded control nut 72 adjusts the gap between the shoe 62 and drum 61 by moving plate 69 relative to base 63. Spring micrometer 73 is fixed to base 63 with its plunger resting upon bracket 70, whereby, upon movement of plate 69, an indication is made upon the micrometer.

Shoe 62 is fixed to shoe base 71 and slides into the channel bounded by plate 69 and brackets 70 where it is locked by nut 74. The overcoating fluid is fed into the meniscus gap between drum 61 and shoe 62 via tubing 65′ which feeds the fluid into the gap through slot 66 (FIG. 5). Excess fluid seeps into boundary channels 67′ which drain out through tube 68.

For further details of the meniscus process and apparatus, attention is directed to copending U.S. Patent Application Ser. No. 382,786, filed on July 26, 1973, now U.S. Pat. No. 3,878,816. That entire disclosure is hereby expressly incorporated herein by reference.

The fluid used in the overcoating process may be fed to tube 65′ in any conventional manner including gravity or under pressure by a pump. The drainage is into a container (not shown).

When used in the overcoating mode, any suitable fluid may be used. For example, the following materials have proven to provide suitable results: KRYLON, a polymethylmethacrylate from Krylon, Inc,; BAVICK II, an $\alpha$-methylstyrene/co-MM from J. T. Baker; LEXAN, a BPA polycarbonate from General Electric; ZERLON 150, a polystyrene/co-MMA from Dow Chemical; P4942, a polymethylmethacrylate from Eastman Kodak; and P47, a polysulfone from Union Carbide.

At this point, it should be pointed out that the overcoating structure described above may also be used to develop images on migration imaging films. This feature is very important in alternative embodiments, as well as explained below.

Development Station

Figure 6:
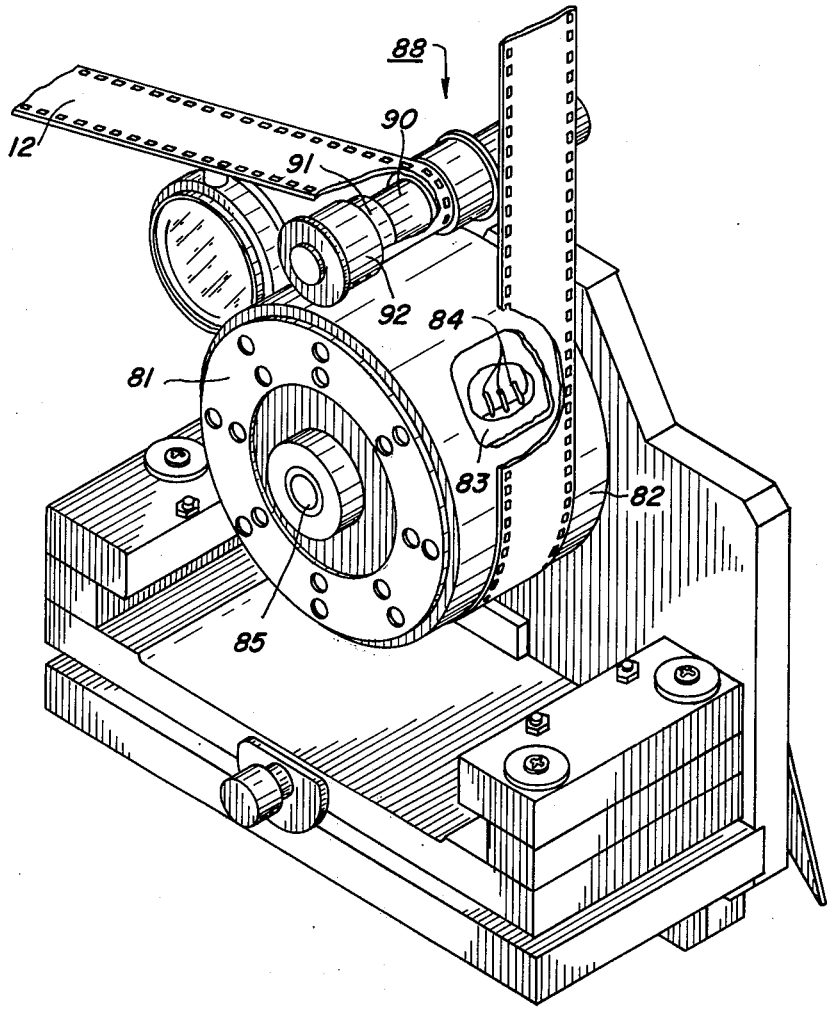
FIG. 6 is a partially schematic, perspective view of the heat development station 80 of FIG. 2.

Referring now to FIGS. 2, 3 and 6, development station 80 will be described. The structure of the heat development apparatus shown comprises a freely rotatable heated drum 81, the surface temperature of which may be varied from about 70° C to about 140° C. The surface 82 of the heated drum 81 is metallic, and preferably a good conductor of heat. The inside surface of the drum comprises a fabric 83 having heating wires or cables 84 embedded therein. Drum 81 rotates freely about shaft 85 which has, on the opposite end thereof, on the backside of midrib 4 (see FIG. 3) slip rings which are continuously engaged by slip ring follower fingers 86 which are held by bracket 87. The slip rings allow for continuous electrical contact for the heating elements, and also for thermocouple feedback from the heater roller.

Note that development station 80 further includes a base structure similar to that of overcoating station 60, minus the shoe and shoe base. As will be explained below, these elements may be added for further embodiments.

FIG. 6 clearly shows the multiple-width film handling roller 88 which is used in various locations throughout the system. The roller is freely rotatable about a shaft and comprises a multi-faceted surface having lands 90, 91 and 92 for guidingly receiving 16mm, 35mm and 70mm films, respectively.

Drying Chambers

There are two identical drying chambers, 100 and 101, positioned in the film path after the overcoating and development stations. The chambers themselves are under a slight vacuum which causes air to circulate over the surfaces of the film to either cool it and/or remove vapors of the development or overcoating fluid.

Figure 7:
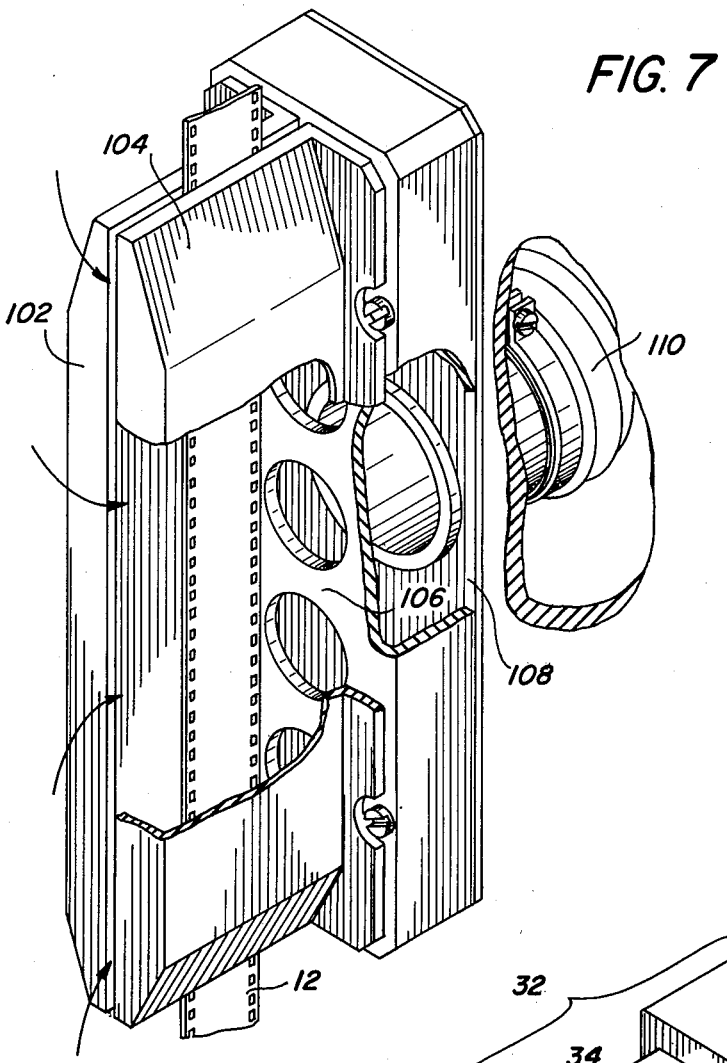
FIG. 7 is a partially schematic, perspective view of the drying chamber 100 or 101 of FIG. 2.

Referring now to FIG. 7, the drying chamber will be described. Two baffles 102 and 104 define a chamber through which the film 12 passes for processing. The baffles are adjustable whereby the gap through which the film passes may be varied to modify air flow. The baffles are mounted to perforated plate 106 which defines one wall of collection chamber 108. A vacuum hose 110 is attached to the collection chamber to provide an exhaust conduit. Note in FIG. 3 that the hoses 110 are provided, at the opposite end, on support bracket 112 with connectors 114 which are connected to a conventional source of vacuum (not shown).

Note further that the midrib includes three light-tight air entry baffles 116, 118 and 119. Because of the vacuum drying chambers, and the tightness of the cabinet, these air baffles are necessary.

SUPPLY AND TAKEUP

The film supply reel 14 tension is controlled by an AC torque motor 120 (see FIG. 3) which wants to rotate in the opposite direction that the film is being payed out. Motor 120 may be any suitable motor, but for purposes of illustration, may be a continuous drive AC torque motor type KCI-26A1, torque rating 7 oz-in from the Bodine Electric Co. of Chicago, Ill. Takeup reel 16 is controlled similarly by AC torque motor 122 which may be, for example, a continuous drive type NCI-13, torque rating 20 oz-in from Bodine, with a particle clutch.

Figure 10:
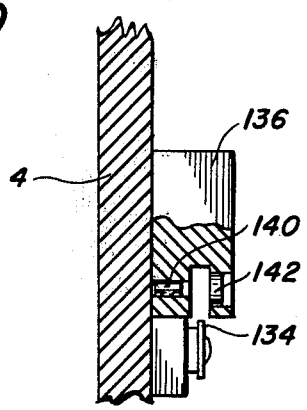
FIG. 10 is a partially schematic, cross-sectional view of a portion of the end of film sensor system shown in FIG. 3.

The end of the film is signalled by sensor system 130 (FIG. 2). Roller 131 works against film 12 until the end passes, allowing arm 132 to move. Arm 132 is attached, through midrib 4, to arm 134 (see FIG. 3) which is biased by spring 138 to cause roller 131 to contact the film firmly. Attention is directed to FIG. 10 which is a partial cross-sectional view of bracket 136 and arm 134. When arm 134 is allowed, by the absence of film, to move with spring 138, it interrupts the light channel between LED 140 and phototransistor 142. The LED and phototransistor perform the function of an optical switch, causing at least the high voltage and maintain film transport to shut down.

Power and Control

Figure 9:
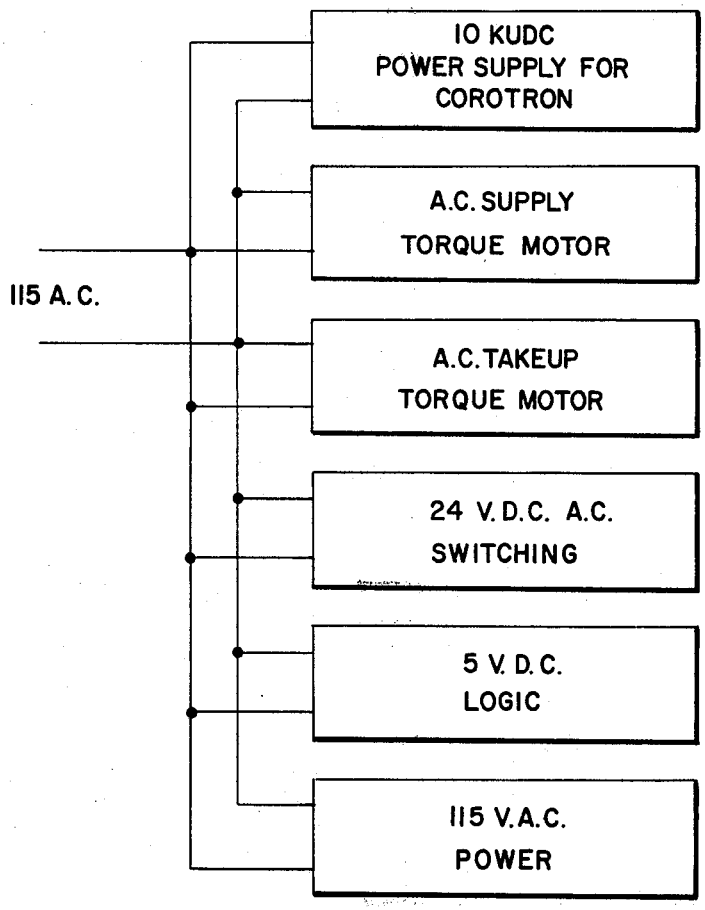
FIG. 9 is a block diagram of the electrical voltage breakdown of the control system.

Referring now to FIG. 9, the power input and breakdown of the control unit is shown (the control unit may be separate from cabinet 1 or an integral part thereof). The 115 VAC input is stepped down by appropriate transformers and rectifiers to 24 and 5 VDC segments.

The corotron used in charging station 20 requires a relatively high DC voltage, as indicated in FIG. 9. Here again, transformers and rectifiers are used to alter the 115 VAC input to a specific output value.

The 24 VDC output controls the AC switching within the system, i.e., energizes the relays to effect AC switching.

The logic circuitry of the control unit is operated on the 5 VDC output segment. The logic circuitry, preferably solid state, controls the operation of the various process elements.

An unaltered segment of the 115 VAC input is used to power several of the system elements.

Specifics of the logic circuitry do not form part of this invention and are not herein described. One of ordinary skill in the art could design such circuitry given the requirements of the camera/processor as delineated herein.

Alternative Embodiments

The apparatus described immediately above may be easily modified or selectively employed to accomplish various advantageous results.

For instance, if it is desired to have only meniscus development the heat development station 80 may be bypassed, along with drying chamber 101, by directing the film from roller 142 to adjustable roller 148 and thence to station 60. Also, a shoe such as 62 (station 60) can be inserted in the base of station 80 to perform meniscus development, in which case station 60 would be bypassed. By using the proper development fluid (solvent) in the meniscus, liquid developed images result.

Alternatively, it may be desirable in certain instances to heat develop the images and then liquid develop them. In such a situation, it is only necessary to use development fluid in the meniscus device at station 60.

Further, by way of example, it may be desirable that meniscus developed images be overcoated. The only modification thereby necessitated is the insertion of a meniscus shoe into the base of station 80. Of course, supply and drainage tubes will have to be affixed to nipples 150 and 152. The drum 81 may be used in this instance with the heat on or off, or, alternatively, may be replaced with a more conventional meniscus drum such as 61.

Even still further, the film may be placed in a light-tight reel cassette, charged at station 20, and transported directly to a light-tight reel cassette at the takeup position. The film has thus been sensitized for use at a remote location such as, for example, in a computer output microfilm camera. The film may, after exposure, then be returned to the camera/processor for development.

Figure 8A:
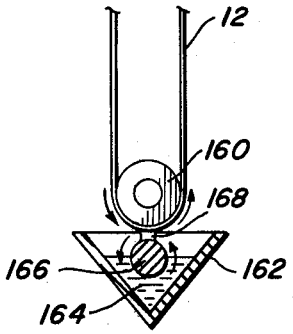
FIG. 8*a* is a partially schematic, partially cross-sectional view of an alternative development apparatus addition to FIG. 2.
Figure 8B:
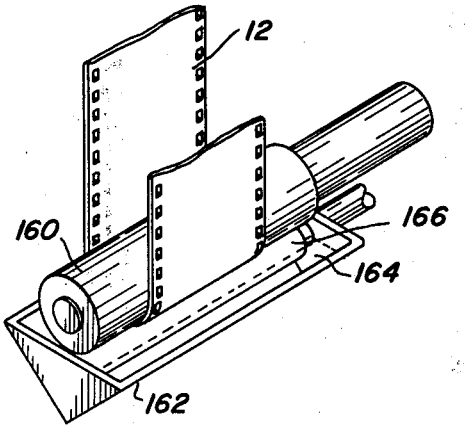
FIG. 8*b* is a partially schematic, perspective view of the single frame development apparatus of FIG. 8*a*.

In another embodiment, roller 160 (FIG. 2) is used with the additional apparatus of FIGS. 8*a* and 8*b*. Trough-like structure 162 is adapted to contain liquid development fluid (solvent) 164 and rotating, partially submerged applicator roller 166. Applicator roller 166 is driven by a motor (not shown) which is positioned, for example, on the opposite side of midrib 4. Preferably, applicator roller 166 rotates opposite in direction to the film. The roller 166 is located closely adjacent to the film surface whereby a meniscus 168 of development liquid 164 is formed therebetween. With this small addition, it is possible to develop selected frames of exposed film, or long stretches of relatively slow moving film.

An alternative single frame development apparatus would replace the chamber 162 and roller 166 of FIGS. 8*a* and 8*b* with a small meniscus shoe. The shoe would be structurally similar to that employed at station 60, but much smaller. It would be located adjacent roller 160 to form the meniscus through which the film passes.

It should be apparent that heat developable or liquid ink developable latently imaged films may be developed at either the thermal or meniscus stations. Liquid ink development processes are well known in the art and usually employ materials such as carbon black suspended in methane. This type of liquid works well in the meniscus developing apparatus of the instant invention. The above-incorporated application Ser. No. 382,786 teaches the use of an electrode shoe for aid in development. Such a modification may also be employed to advantage herein in both liquid ink development and migration imaging development.

Numerous other film paths and modifications may be devised by one of skill in the art, and after the above disclosure will be obvious.

Specifics of the logic control circuitry do not form part of this invention and are not herein described. One of ordinary skill in the art could design such circuitry given the requirements of the camera/processor as delineated above.

Although specific components proportions and process steps have been stated in the above description of preferred embodiments of the invention, other suitable materials, proportions and process steps, as listed herein, may be used with satisfactory results and varying degrees of quality. In addition, other materials which exist presently or may be discovered may be added to materials used herein to synergize, enhance and otherwise modify their properties.

It will be understood that various changes in the details, materials, steps and arrangements of parts which have been described and illustrated in order to explain the nature of the invention, will occur to, and may be made by those skilled in the art upon a reading of the disclosure within the principles and scope of the invention.

What is claimed is:

1. An apparatus for exposing and developing film comprising:

film supply means for holding a supply of film and dispensing it upon demand, said supply means being under a torque opposite in direction to that in which the film is being dispensed;

means for guiding the film along a predetermined path from said supply means to a takeup means;

charging means adjacent the predetermined path for depositing a uniform charge upon the surface of the film;

exposure means adjacent the predetermined path, after said charging means, for exposing the charged film comprising vacuum means for holding the film in a substantially flat plane and means to control imagewise exposure of the film;

drive means adjacent the predetermined path, after the exposure means, cooperating with the takeup means to cause the film to move along the predetermined path;

first development means adjacent the predetermined path, after said drive means, for developing the film comprising a freely rotatable drum member having electrical means to heat the surface thereof, said surface adapted to contact film whereby the film is developed;

overcoating means adjacent the predetermined path, after said first development means, for creating a liquid meniscus of overcoating materials through which the developed film passes comprising a drum member mounted on a shaft for free rotation, a shoe member having a curved surface substantially the same radius as the drum member, said shoe member supported adjacent the drum member for adjustable movement into close proximity of the drum member along the periphery thereof to form a gap therewith, and means to deposit and remove overcoating fluid from the gap created between the drum member and the shoe member;

drying means adjacent the predetermined path, after said overcoating means, for passing air over the film;

said takeup means being under a torque for receiving the film;

and second development means adjacent the predetermined path, after said drive means and before said first development means.

2. The apparatus of claim 1 wherein said second development means comprises:

a drum member mounted on a shaft for free rotation, a shoe member having a curved surface with substantially the same radius as said drum member, the length of said curved surface of said second development means smaller than the length of the curved surface of the shoe member of said first development means, said shoe member of said second development means supported adjacent said drum member for adjustable movement into close proximity of said drum member and along the periphery thereof to form a gap therewith, and means to deposit and remove developing fluid from the gap created betwen said drum member and said shoe member of said second development means.

3. The apparatus of claim 1 wherein said second development means comprises:

a first roller means adapted to guidingly receive the film, said first roller means being freely rotatable and of a diameter smaller than the diameter of said drum member of said first development means, container means for holding a volume of development fluid at a specific level, said container means positioned adjacent said first roller means.

a rotating second roller means partially below said specific level and closely adjacent said first roller means whereby a meniscus of development fluid will extend between said first and second roller means.

4. The apparatus of claim 3 wherein said second roller means is rotated opposite to said first roller means.

5. Apparatus for exposing and developing film comprising:

film supply means for holding a supply of film and dispensing it upon demand, said supply means being under a torque opposite in direction to that in which the film is being dispensed;

means for guiding the film along a predetermined path from said supply means to a takeup means;

charging means adjacent the predetermined path for depositing a uniform charge upon the surface of the film;

exposure means adjacent the predetermined path, after said charging means, for exposing the charged film to an imagewise pattern of activating electromagnetic radiation and creating an imagewise electrostatic latent image on the film;

drive means adjacent the predetermined path, after said exposure means, cooperating with said takeup means to cause the film to move along the predetermined path;

development means adjacent the predetermined path, after said drive means, for developing the latent image on the film comprising:

a drum member mounted on a shaft for free rotation, a shoe member having a curved surface with substantially the same radius as said drum member, said shoe member supported adjacent said drum member for adjustable movement into close proximity of said drum member and along the periphery thereof to form a gap therewith, and means to deposit and remove developing fluid from the gap created between said drum member and said shoe member;

overcoating means adjacent the predetermined path, after said development means, for creating a liquid meniscus of overcoating materials through which the developed film passes;

first drying means adjacent the predetermined path, after said overcoating means, for passing air over the film;

said takeup means for receiving the film being under a torque; and second drying means adjacent the predetermined path, after said first development means, for passing air over the film.

* * * * *